US005785219A

United States Patent [19]

Kraft

[11] Patent Number: 5,785,219

[45] Date of Patent: Jul. 28, 1998

[54] COMBINATION KNAPSACK

[75] Inventor: Jeffrey J. Kraft, Prescott, Wis.

[73] Assignee: The Pack Company, Minneapolis, Minn.

[21] Appl. No.: 566,932

[22] Filed: Dec. 4, 1995

Related U.S. Application Data

[63] Continuation-in-part of Ser. No. 74,430, Jun. 9, 1993, abandoned, which is a continuation-in-part of Ser. No. 21,952, Feb. 23, 1993, abandoned.

[51] Int. Cl.[6] ..... A45C 3/14; A45F 4/06; A45F 4/02; A47G 9/06

[52] U.S. Cl. ..... 224/576; 224/156; 224/153; 224/580; 224/625; 224/901.2; 2/66; 2/69.5; 5/419; 383/4

[58] Field of Search ..... 224/576, 577, 224/153, 625, 156, 901.2, 580; 383/4; 190/2; 5/419, 420, 417; 2/69.5, 69, 66, 91

[56] References Cited

U.S. PATENT DOCUMENTS

| | | | |
|---|---|---|---|
| 1,930,942 | 10/1933 | Pringle . | |
| 2,264,471 | 12/1941 | Glenn | 2/69 |
| 2,540,165 | 2/1951 | Fiel . | |
| 2,783,473 | 3/1957 | Humpeler | 2/69 |
| 2,898,609 | 8/1959 | Storie . | |
| 3,774,249 | 11/1973 | Ybarra et al. . | |
| 4,124,908 | 11/1978 | Burns et al. | 2/69.5 |
| 4,154,323 | 5/1979 | Sneider . | |
| 4,164,275 | 8/1979 | Davis . | |
| 4,164,308 | 8/1979 | Gautier | 224/637 |
| 4,258,439 | 3/1981 | York | 2/69.5 |
| 4,634,618 | 1/1987 | Greer et al. . | |
| 4,810,102 | 3/1989 | Norton . | |
| 4,836,426 | 6/1989 | Munn et al. | 224/637 |
| 5,346,308 | 9/1994 | Buhot et al. . | |
| 5,454,125 | 10/1995 | Ratkowski | 5/419 |
| 5,588,570 | 12/1996 | Zirbel | 224/155 |

FOREIGN PATENT DOCUMENTS

| | | |
|---|---|---|
| 2626152 | 7/1989 | France . |
| 3913696 | 10/1990 | Germany . |

*Primary Examiner*—Linda J. Sholl
*Attorney, Agent, or Firm*—Gerald E. Helget; Mackall, Crounse & Moore, PLC

[57] ABSTRACT

A combination knapsack including a mat permanently attached to one of the walls of a main storage compartment and a flap permanently attached to another of the walls of the main storage compartment. In a storage mode of use, the mat is completely retained within the main storage compartment of the knapsack and the flap covers the opening to the main storage compartment. In an operational mode of use, the mat is fully extended outside the knapsack and the flap is either on the knapsack or on the mat to be used as a headrest or pillow. In another embodiment, the knapsack further comprises a blanket that may be closed about the legs of the wearer in a sitting position and an insulating handwarming muff.

12 Claims, 7 Drawing Sheets

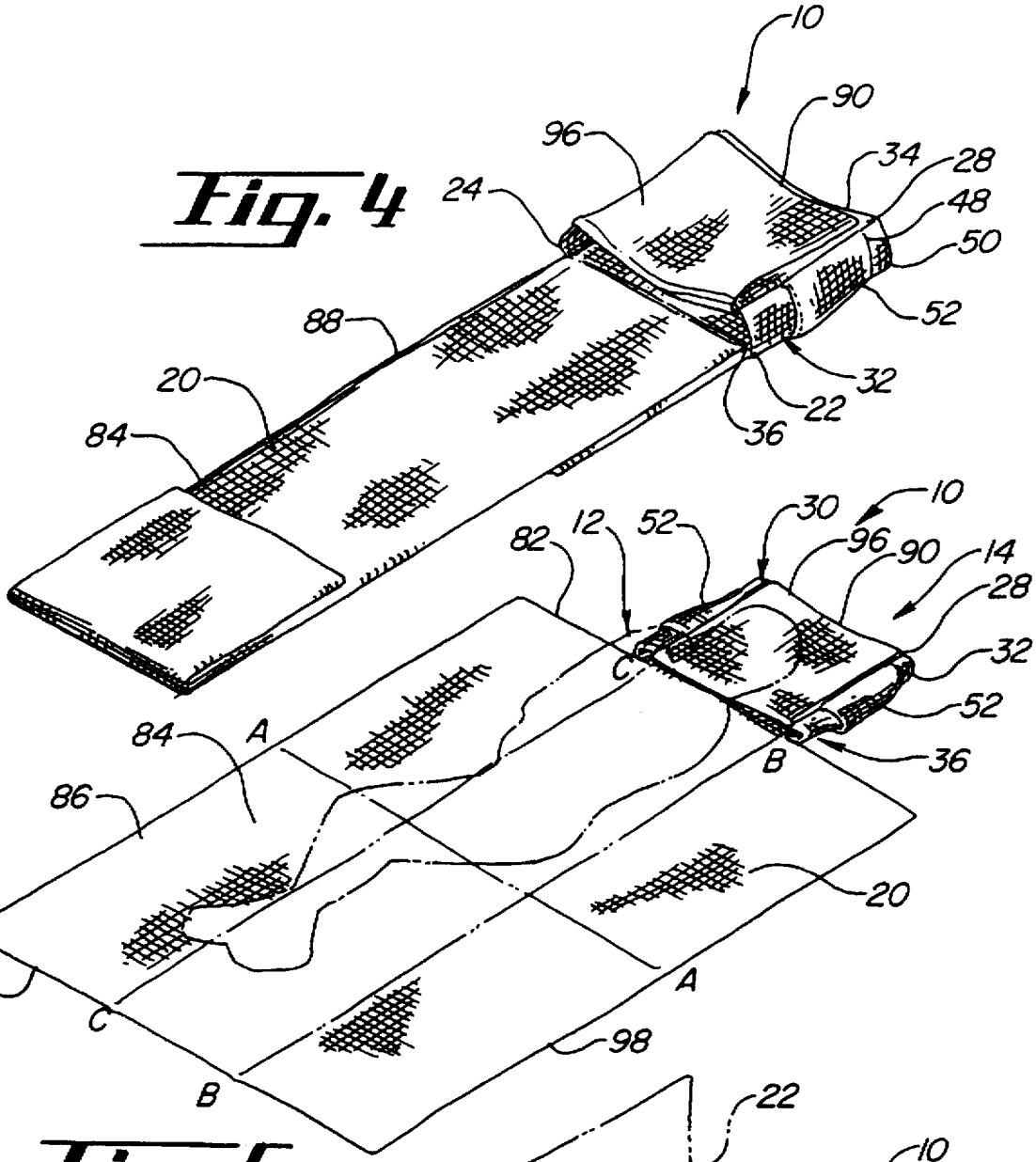
Fig. 4
Fig. 5
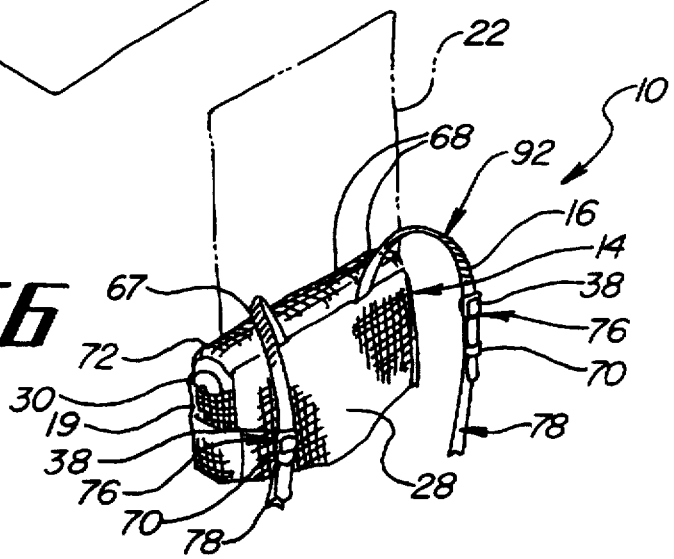
Fig. 6

COMBINATION KNAPSACK

BACKGROUND OF THE INVENTION

This application is a continuation-in-part of application Ser. No. 08/074,430 filed Jun. 9, 1993 now abandoned, which is a continuation-in-part of application Ser. No. 08/021,952 filed Feb. 23, 1993 now abandoned.

The present invention relates generally to the field of portable storage compartments. More specifically, it relates to a knapsack with an attached mat and headrest.

There are many settings in which it is convenient to have a comfortable mat and headrest to sit or lie upon and personal belongings nearby, such, as for example, when going to the beach, when attending an outdoor athletic event, when hiking, when picnicking, when changing a baby or when a child rests on a mat at a day care facility or school. It is cumbersome to carry both a blanket or mat and pillow under one's arms. Especially for children, a standard size blanket and pillow are too bulky and unwieldy to carry any distance. Even child-size sleeping mats or play mats are often too bulky to be carried easily. In addition, a separate pillow and mat increase the likelihood that either the mat or pillow will be lost.

One partial solution to this problem is attaching a special pocket to a mat so that the blanket can be folded and placed in the pocket for use as a pillow, such as, for example, the Pillow/Quilt sold by Improved Living® of Warren, Pa. or the Undercover Coverlet pattern described in the July/August 1989 issue of *Quilter's Newsletter Magazine* (QNM) and often referred to as a secret pillow, magic pillow, or quilt-in-a-pillow. However, this solution permits use of either a blanket or a pillow but not both together and lacks any convenient carrying mechanism or storage for personal belongings. This solution is also challenging to use for children or physically impaired users.

Many travelers are familiar with knapsacks that fold into a small pocket or raincoats that fold like road maps into small pouches. However, these items typically require complex and careful folding and fastening of the larger item in order to get it to fit into a small pouch. This type of folding and fastening is difficult for a young child or physically impaired user, and many of these items are not easily washed as a unit.

An invention that would provide an integral mat and pillow that is easily stored and carried along with personal belongings in a compact form would be greatly appreciated.

Another objective of the present invention is to provide a knapsack with attached mat and pillow which is easily washable and reusable as an integrated unit.

A further objective of the present invention is to provide a portable protective covering which is lightweight and provides a comfortable resting or sitting area.

A further objective of this invention is to provide a blanket attached to a knapsack which is closable about the wearer's legs in a sitting position.

A further objective of this invention is to provide a flap with an insulated handwarming muff.

SUMMARY OF THE INVENTION

The present invention provides a convenient, compact apparatus to carry a mat and pillow as well as personal belongings and minimize the likelihood of losing either the mat or the pillow.

This invention is a combination knapsack comprising a main storage compartment defined by a front wall, a back wall and a base wall; carrying straps connected to at least one of the walls for a user to readily carry the knapsack; a mat for use as a protective covering permanently attached to one of the walls of the compartment so that during a storage mode of use the mat is completely retained within the knapsack; and in an operational mode of use the mat is fully extended outside the knapsack; and a flap permanently attached to at least one of the walls of the main compartment and extending over the main storage compartment. The flap can be placed in an open position whereby a user can retrieve the mat stored in the main storage compartment and a user can use the flap as a headrest or pillow. The flap can also be placed in a closed position to cover the main storage compartment.

In an alternate embodiment, the invention further includes a pillow attached to the compartment and enclosable with the compartment when the knapsack is used in the storage mode. The invention also provides additional pockets to store personal belongings.

In an alternate embodiment, the invention further includes a blanket that is switchable between a storage mode of use in which the blanket is completely retained within the knapsack and an operational mode of use in which the blanket is fully extended outside the knapsack.

The blanket is closable about the wearer's legs in a sitting position. The invention also has a flap means with an insulated handwarming muff.

An object and advantage of this alternate embodiment is that the blanket and handwarming muff offer substantial protection from the cold while the wearer is sitting down, for example in a deer stand or at a stadium.

A feature of this alternate embodiment is that the blanket has fabric hook material attached to it and the inner insulating layer of the blanket is comprised of fabric loop material, so that the blanket can be closed about the wearer's legs easily without the need to match up the fabric hook material with the fabric loop material. This is a great advantage at night, in low light conditions, or in windy conditions.

Another feature of this alternate embodiment is that the knapsack has connectors for attaching the knapsack to the wearer's waist. In this manner, the knapsack 210 may be prevented from moving around and catching on obstructions as for example when the wearer moves through heavy brush or woods.

BRIEF DESCRIPTION OF THE DRAWINGS

FIG. 4 is a perspective view of the knapsack with the mat further partially opened;

FIG. 5 is a perspective view of the knapsack with the mat fully opened;

FIG. 6 is a perspective view of an alternate embodiment of the knapsack in accordance with the present invention;

DETAILED DESCRIPTION OF THE PREFERRED EMBODIMENTS

Figure 1:
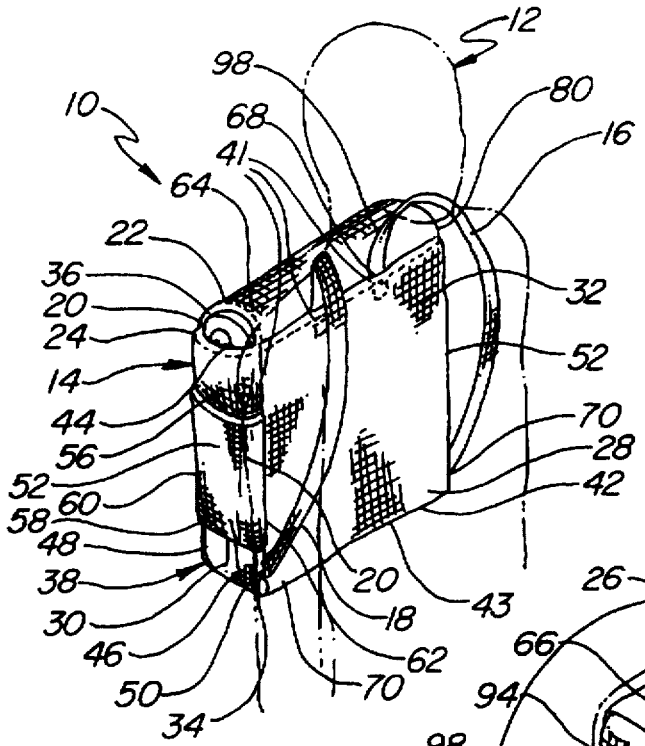
FIG. 1 is a vertical perspective view of a knapsack in accordance with the present invention in the storage mode.
Figure 7:
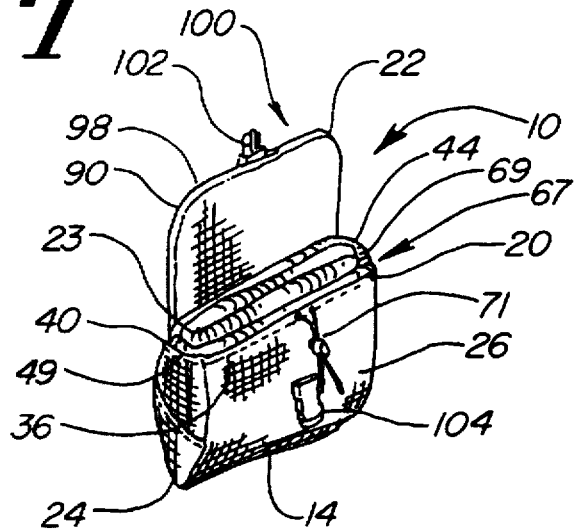
FIG. 7 is a perspective view of an alternate embodiment of the knapsack with a separately attached pillow.

FIG. 1 illustrates a knapsack 10 worn by a user 12 depicted by phantom lines. The knapsack 10 includes a pouch 14, a pair of carrying straps 16, 18, a mat 20 and a protective flap 22, shown in a substantially closed position. Referring to FIG. 7, in an alternate embodiment of the invention, the knapsack 10 further includes a pillow 23.

Pouch 14 broadly defines structure forming an enclosable compartment 24 defined by a front wall 26, a back wall 28, opposed side panels 30, 32, and a base wall 34. Pouch 14 presents a characteristic width W and length L. Front wall 26 includes a top front margin 36 and a bottom front margin 38. Back wall 28 includes a back front margin 40, back side margin 41, bottom, back margin 42 and lower portion 43. Side panels 30, 32 each include a top side margin 44 and bottom side margin 46.

In a preferred embodiment, pouch 14 is constructed from one or more pieces of strong, lightweight, washable, resilient material, such as, for example, parachute-like material. Each of side panels 30, 32 preferably includes a front section 48 and a back section 50. In a preferred embodiment, front wall 26 and front section 48 of each of side panels 30, 32 are a unitary piece of material and back wall 28 and back section 50 of each of side panels 30, 32 are a unitary piece. In a further preferred embodiment, compartment 24 is formed by attaching front section 48 of each of side panels 30, 32 to back section 50 of each of side panels 30, 32 and securing base wall 34 along bottom front margin 38, bottom back margin 42, and bottom side margin 46 of each of side panels 30, 32. It is recognized that, in an alternate embodiment, front wall 26 may include base wall 34 in a unitary piece, or alternately, back wall 28 or side panels 30, 32 may include base wall 34 in a unitary piece or, in another embodiment, pouch 14 may be a single unitary, or substantially unitary piece of material.

Figure 2:
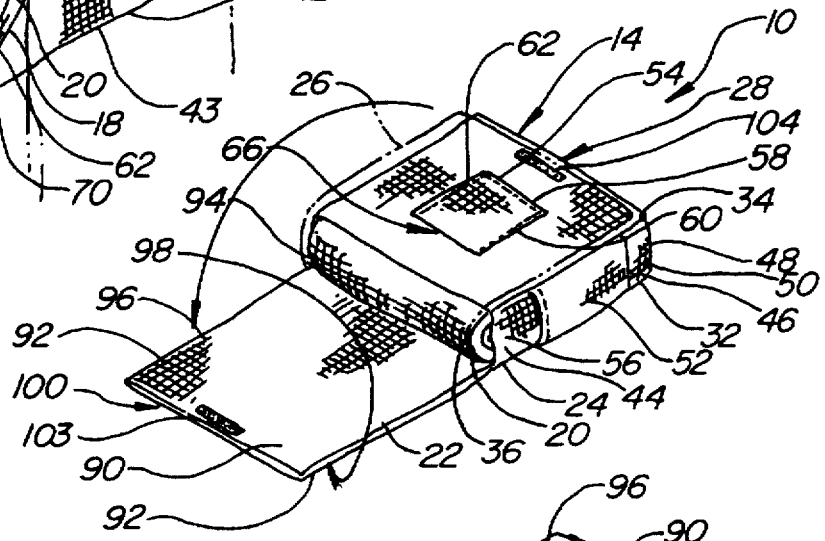
FIG. 2 is a horizontal perspective view of the knapsack with the main compartment open.

Referring to FIGS. 1 and 2, in an alternate embodiment, pouch 14 includes one or more pockets 52, 54. Pockets 52, 54 are generally rectangular pieces of material and include an upper pocket edge 56, lower pocket edge 58 and opposed side edges 60, 62. As depicted in FIG. 1, side edges 60, 62 of pockets 52, 54 are attached to front wall 26 and back wall 28 and lower pocket edge 58 is attached to side panels 30, 32 of pouch 14 whereby pockets 52, 54 and side panels 30, 32 of pouch 14 form a structure defining a storage cavity 64 for holding a beverage or food container.

Referring to FIG. 2, in an alternate embodiment, pocket 54 is either alternatively or additionally attached to front wall 26 along lower pocket edge 58 and side edges 60, 62 whereby pocket 54 and front wall 26 form a structure defining a storage slot 66 for holding personal belongings. In another alternate embodiment, each of the pockets 52, 54 includes a fastening system comprised of a plurality of male snap fasteners along the upper pocket edge 56 and opposed female snap fasteners attached to pouch 14 along a line parallel to a directly adjacent to upper pocket edge 56. It is recognized that the fastening systems could also be made of, for example, hook and loop elements, buttons and buttonholes, zippers, or hook and eye assemblies.

Referring to FIG. 6, in an alternate embodiment, pouch 14 includes a fastening system 67, depicted here as a zipper, attached to pouch 14 along top front margin 36, back front margin 40, and, alternatively, top side margins 44. It is recognized that fastening system 67 could be similar to those described above or shown in FIG. 7. In FIG. 7, the fastening system 67 includes structure defining a casing 69 and a drawstring 71 extending through the casing 69. The casing 69 extends along the top front margin 36, back front margin 40 and top side margins 44.

Referring to FIG. 1, carrying straps 16, 18 each include an upper end 68 and a lower end 70. Upper end 68 of each strap 16, 18 is attached to pouch 14 on back wall 28 along top back margin 40. Lower end 70 of each strap 16, 18 is attached to pouch 14 along each back side margin 41 of back wall 28 adjacent to lower portion 43 of back wall 28.

In an alternate embodiment, upper end 68 and lower end 70 of strap 16 are attached to pouch 14 along top back margin 40 of back wall 28 and upper end 68 and lower end 70 of strap 18 is attached to pouch 14 along top back margin 40 so that the carrying straps function as handles. In another alternate embodiment, the carrying means comprises strap 16 as a single strap attached to side panels 30, 32 of pouch 14, with sufficient length to place the carrying strap over a user's shoulder.

Referring to FIG. 6, in an alternate embodiment, straps 16, 18 include an upper strap portion 72, a lower strap portion 74, and a connecting mechanism 76. Connecting mechanism 76 broadly includes a slide 78 and clip 80. In an alternate embodiment, the slide 78 and clip 80 are attached to lower strap portion 74 and upper strap portion 72 is woven through slide 78 and clip 80 to secure upper strap portion 72 to lower strap portion 74. It is recognized that connecting mechanism 76 may be made from, for example, hook and loop elements, buttons and buttonholes, male/female snap elements, buckle and tongue holes, a plurality of clips or hook and eye assemblies.

Figure 12:
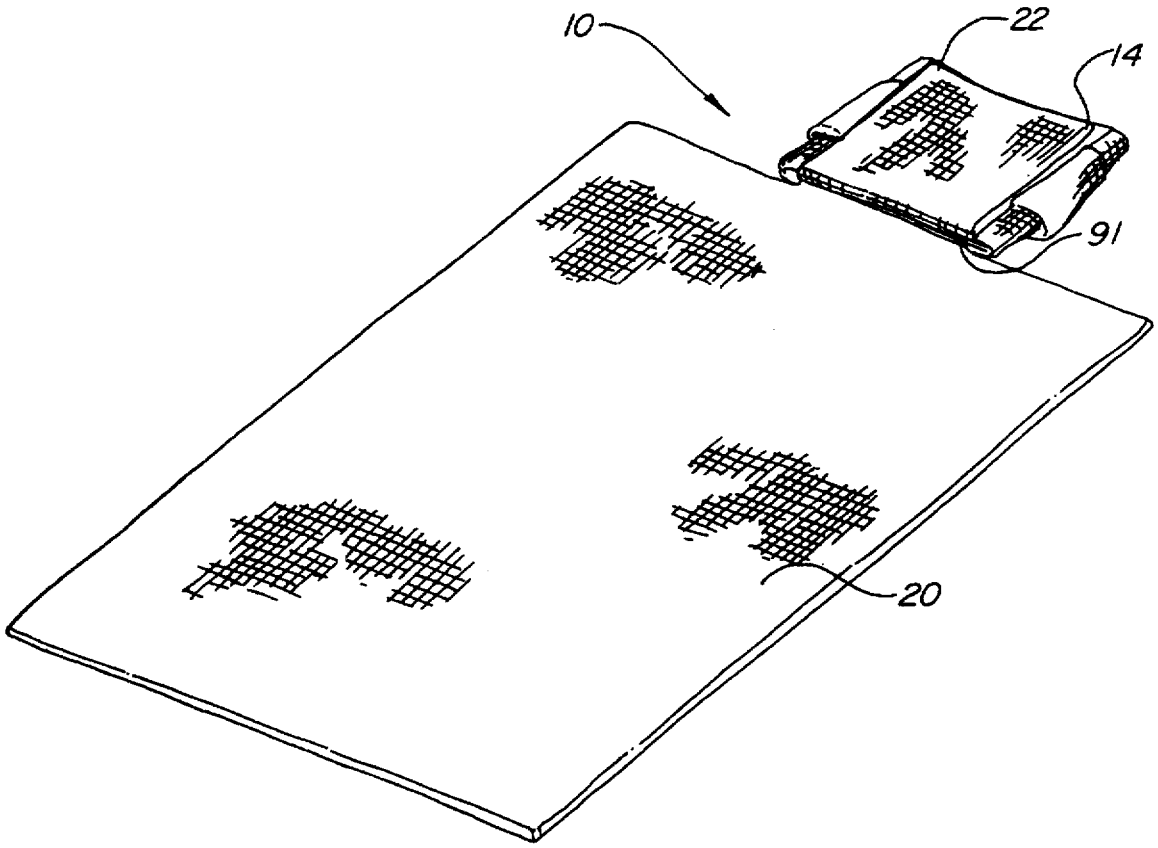
FIG. 12 is a perspective view of an alternate embodiment of the knapsack in accordance with the present invention showing the selective detachability of the mat.

Referring to FIG. 5, mat 20 includes an upper mat edge 82, a lower mat edge 84, a left side edge 86, a right side edge 88 and presents a top mat face 89. It will be understood that the designations right and left are arbitrary and may be reversed depending upon the view chosen. In a preferred embodiment, a portion of upper mat edge 82 is permanently attached to top front margin 36 of pouch 14. Referring to FIG. 12, in an alternate embodiment, the mat 20 includes an attachment mechanism 91. It will be understood that the attachment mechanism 91 may include, for example, a zipper, hook and loop elements, buttons and buttonholes, male/female snap elements, buckle and tongue holes, a plurality of clips or hook and eye assemblies. It is recognized that mechanisms having similar function are within the scope of this attachment mechanism 91. In a preferred embodiment, mat 20 is comprised of one or more layers of soft cushiony material joined together to form a unitary piece.

In a preferred embodiment, the proportions of mat 20 and pouch 14 are such that mat 20 presents a width (annotated A—A in FIG. 5) extending between the left and right edges 86, 88 of the mat 20 which is generally greater than the width W of pouch 14, with a preferred ratio of about three times the width. The length of mat 20 (annotated B—B in FIG. 5) extends from upper mat edge 82 to lower mat edge 84 and is generally a multiple of the length L of pouch 14.

Referring to FIG. 2, flap 22 broadly includes a leading flap edge 90, opposed side flap edges 92, a trailing flap edge 94, an inner face 96 and an outer face 98. Trailing flap edge 94 is attached to pouch 14 along top back margin 40. Flap 22 is of sufficient size to extend between top side margins 44 of side panels 30, 32 and between the top back margin 40, across the compartment 24 to the bottom front margin 38 of front wall 26. In a preferred embodiment, flap 22 is comprised of one or more layers of soft cushiony material joined together. In an alternate embodiment, flap 22 is comprised of a soft washable material forming inner face 96 and outer face 98 and enclosing washable, deformable yet shape-retaining material, such as known filling material, such as, foam or other material commonly used for pillows, for supporting and cushioning the human head.

In another alternate embodiment, flap 22 includes a pocket 54 attached to the inner face 96 of flap 22 along the lower pocket edge 58 and side edges 60, 62 so that pocket 54 and inner face 96 form a structure defining a storage slot 66 for holding personal belongings or other items, such as, for example, an inflatable pillow or additional cushioning.

In a preferred embodiment, front wall 26 and flap 22 include a fastening system 100. Referring to FIG. 7, the fastening system 100 includes a clasp 102 affixed to the leading flap edge 90 or, alternatively, to the outer face 98 of the flap 22 and a clasp receiving member 104 attached to the front wall 26 of the pouch 14. It is understood that fastening system 100 may be made from, for example, hook and loop elements, buttons and buttonholes, male/female snap element, buckle and tongue holes, or a plurality of clips or hook and eye assemblies.

Figure 9:
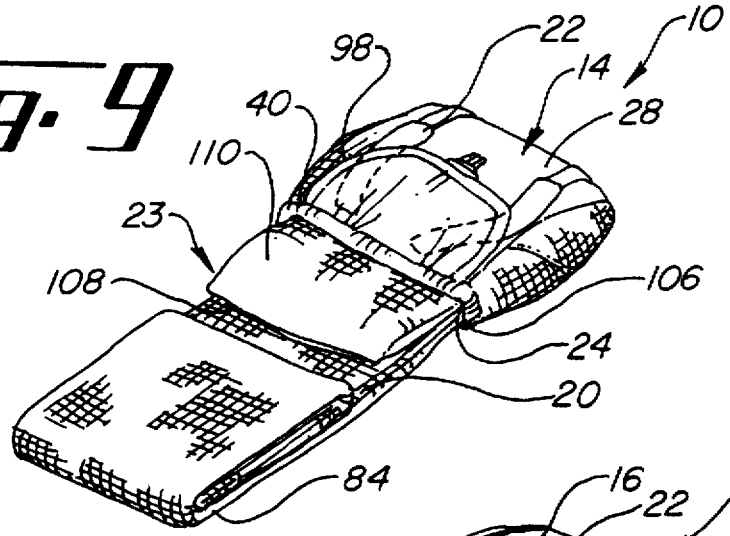
FIG. 9 is a perspective view of the knapsack of FIG. 7 with the mat partially removed in the operational mode.

Referring to FIG. 9, in another embodiment, the pillow 23 broadly includes a pillow edge 106, an inner pillow face 108 and an outer pillow face 110. The pillow 23 is attached to the top back margin 40 of the pouch 14 along the pillow edge 106. The pillow 23 is comprised of a soft washable material enclosing washable, deformable yet shape-retaining material, such as known filling material, such as foam or other material commonly used for pillows, for supporting and cushioning the human head.

Figure 8:
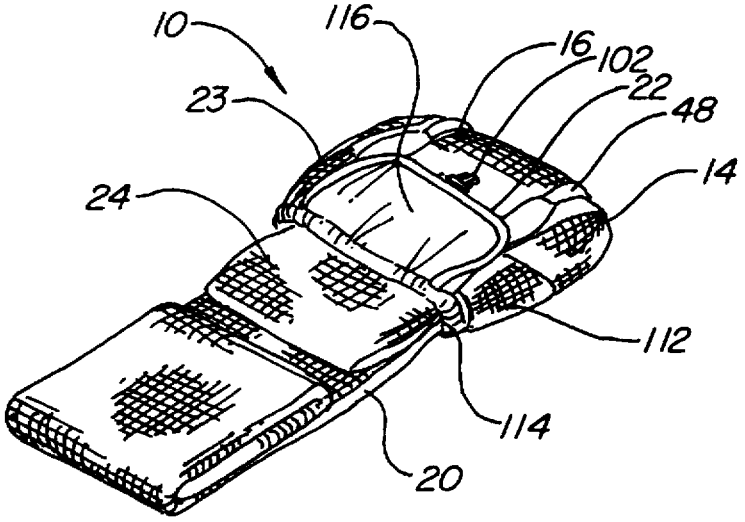
FIG. 8 is a perspective view of an alternate embodiment of the pillow of FIG. 7.

Referring to FIG. 8, in an alternate embodiment of the pillow 23, the pillow 23 includes a case 112 and a cushion 114. The case 112 includes structure defining a cushion receiving slot 116. The cushion 114 is comprised of a soft washable material enclosing washable, deformable yet shape-retaining material, such as known filling material, such as, foam or other material commonly used for pillows.

Figure 3:
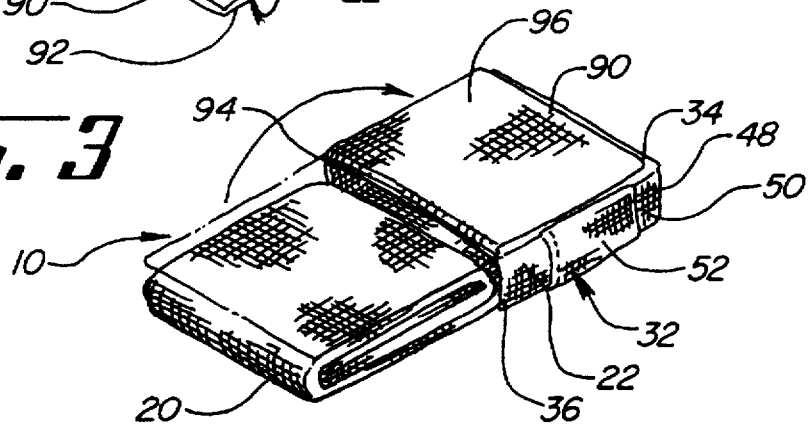
FIG. 3 is a perspective view of the knapsack with the mat partially removed in the operational mode.

Referring to FIGS. 3, 4 and 5, in operation, knapsack 10 functions in either a use mode or a storage mode. In the use mode, in a preferred embodiment, the outer face 98 of flap 22 is placed against the back wall 28 of pouch 14 to open the knapsack 10. Mat 20 is then easily removed from the compartment 24 and unrolled so that the right and left side edges 86, 88 are fully extended to width A—A and the upper mat edge 82 and lower mat edge 84 are fully extended to length B—B. As shown by the phantom lines in FIG. 5, the user 12 may lie on mat 20 and place his head on flap 22 and pouch 14. The attachment of mat 20 to pouch 14 minimizes the chance that mat 20 will be misplaced and provides a portable, convenient protection against the floor or ground, as well as a fixed means for relatively positioning mat 20 and the head supporting flap 22. Use of the fastening system 67, such as that depicted in FIG. 7, further ensures that the mat 20 remains protected within the compartment 24 in the storage mode. For example, as shown in FIG. 7, when the drawstring 71 is tightened, the top front margin 36, back front margin 40, and top side margins 44 are biased close together such that the mat 20 is secured within the compartment 24.

Referring to FIGS. 3, 4 and 5, the use of flap 22 as a pillow or headrest eliminates the need to carry a separate pillow. Alternatively, the user 12 may place inner face 96 of flap 22 against the mat 20 whereby the user's head 12 is cushioned by flap 22 and mat 20. In another alternate configuration, the user 12 places inner face 96 of flap 22 against mat 20 and sits upright on flap 22 while wrapping mat 20 around the user's leg 12.

In yet another alternate embodiment, flap 22 may be fastened to the front wall 26 by the fastening system 100 so that front wall 26 and flap 22 define a tube forming a handwarming muff. In the use mode, the user 12 places his hands within the tube to protect the hands from the weather. Referring to FIG. 7, for example, such that the clasp 102 is received within the clasp receiving member 104 to secure the flap 22 when the knapsack 10 is in a storage mode.

In another embodiment, top mat face 89 can be printed or decorated with a children's action scene (or rest scene) and provide a protective play area when the mat 20 is fully opened. For example, top mat face 89 may be decorated with popular board games, such as the ancient game of pachisi or checkers or a street scene, to encourage and enhance a child's educational and recreational skills. When the mat 20 is open, the top mat face 89 becomes the playing surface or board for the game.

In the storage mode, mat 20 is placed in the compartment 24 of pouch 14. More specifically, in a preferred embodiment, mat 20 is folded into sections, such as thirds, lengthwise as follows: the left side edge 86 of the mat 20 is placed along line B—B and the right side edge 88 of mat 20 is placed along the resulting fold (annotated as line C—C in FIG. 5). Mat 20 is then rolled or generally folded to a size which fits easily into compartment 24 of knapsack 10.

Once mat 20 is stored in the compartment 24, user 12 may store additional personal belongings, such as food, beverages, or a wallet, in the pockets 52, 54 or in the compartment 24. In a preferred embodiment, the user 12 places his arms through the opening formed by the carrying straps 16, 18 and pouch 14 so that the carrying straps 16, 18 rest over the user's shoulders 12 and the back wall 28 of pouch 14 rests against the user's back 12.

Figure 10:
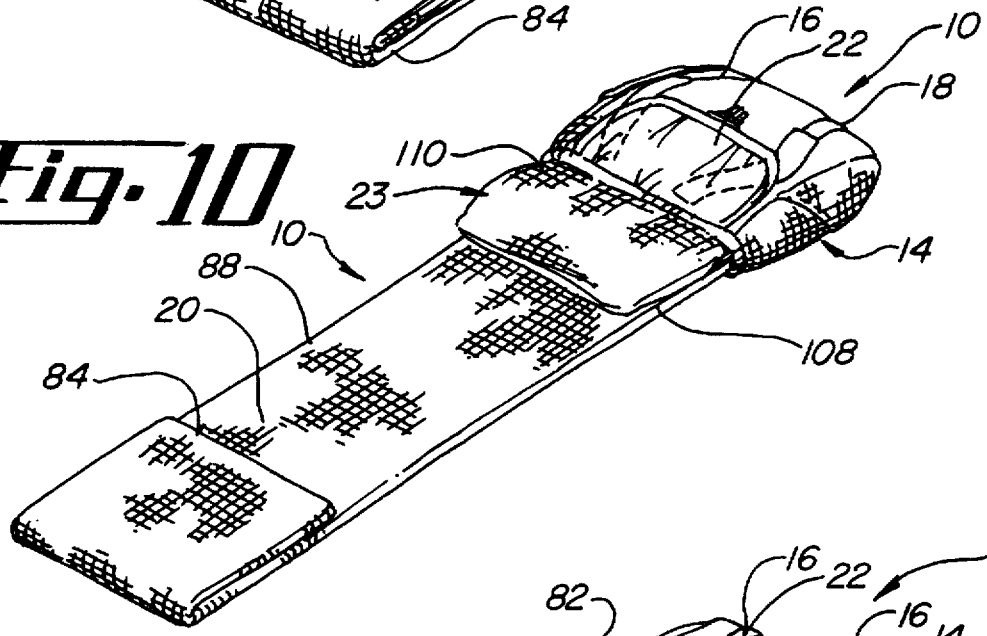
FIG. 10 is a perspective view of the knapsack of FIG. 7 with the mat further partially opened.
Figure 11:
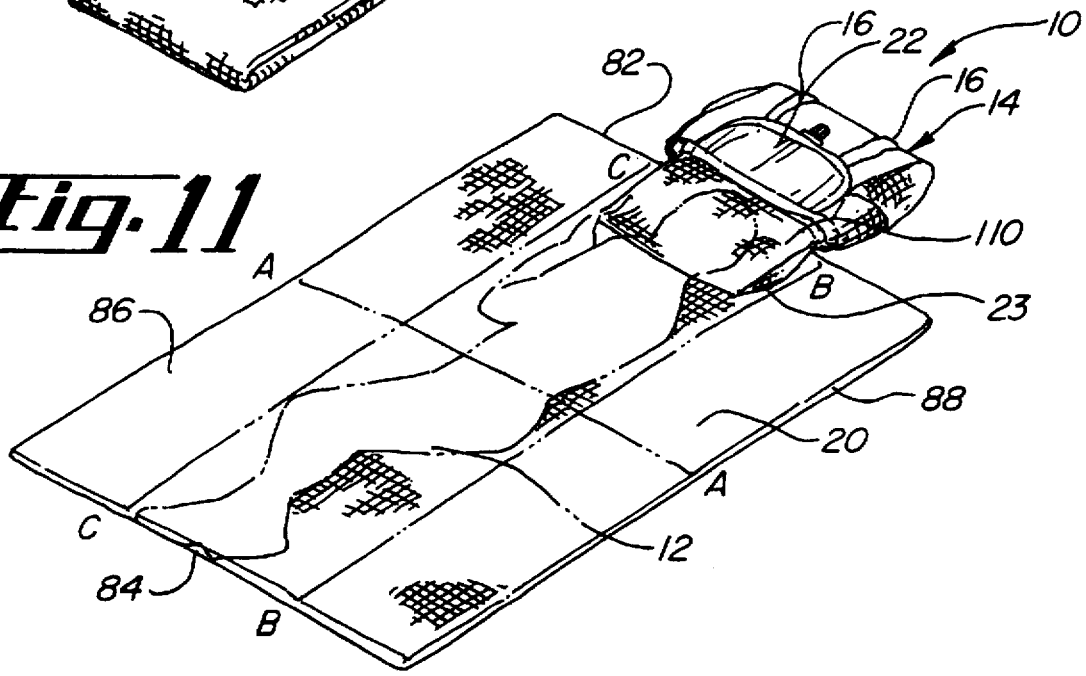
FIG. 11 is a perspective view of the knapsack of FIG. 7 with the mat fully opened.

Referring to FIGS. 9, 10 and 11, in operation, in the alternate embodiment of the knapsack 10 including a pillow 23, in the use mode, the outer face 98 of flap 22 is placed against the back wall 28 of pouch 14 to open the knapsack 10. The pillow 23 and mat 20 are then easily removed from the compartment 24. As previously described, the mat 20 is unrolled so that the right and left side edges 86, 88 are fully extended to width A—A and the upper mat edge 82 and lower mat edge 84 are fully extended to length B—B. The pillow 23 is placed on the mat 20 with the inner pillow face 108 against the mat 20. As shown by the phantom lines in FIG. 11, the user 12 may lie on mat 20 and place his head on the outer pillow face 110. The attachment of mat 20 and pillow 23 to pouch 14 minimizes the chance that mat 20 or pillow 23 will be misplaced.

In the alternate embodiment, shown in FIG. 7, attachment of the pillow 23 minimizes or, in some instances eliminates, the chance that the pillow would be lost or misplaced. In this alternate embodiment, the pillow 23 is placed within the pouch 14 in the storage mode. Placement of the pillow 23 within the pouch 14 reduces the exposure of the pillow 23 to soil and contaminants.

Referring to FIG. 8, the cushion 114 is placed within the case 112 through the cushion receiving slot 116. This configuration allows the cushion 114 to be inserted or removed as the use desires. If the cushion 114 is removed, the case 112 may be used as an additional storage compartment. In addition, the removal of the cushion 114 from the case 112 allows the cushion 114 to be cleaned and washed separately from the knapsack 10.

In the storage mode, both the mat 20 and the pillow 23 are placed in the compartment 24 of pouch 14. More specifically, the mat 20 is rolled or generally folded to a size which fits easily into compartment 24 of knapsack 10 as previously described. The pillow 23 is placed in the compartment 24 with the inner pillow face 108 against the back wall 28.

The use of compact, lightweight materials for pouch 14, mat 20, flap 22 and pillow 23 minimizes the total weight of the knapsack 10 and obviates the bulkiness of carrying a separate blanket and separate pillow. In the alternate embodiment shown in FIG. 12, the attachment mechanism 91 enables the user 12 to selectively detach the mat 20 from the pouch 14 to wash or clean the mat 20. This is desirable, for example, when the pouch 14 and flap 22 are constructed of a material which is somewhat difficult to clean, such as leather, and the mat 20 and pillow 23 are constructed of a highly washable material, such as cotton.

Figure 13:
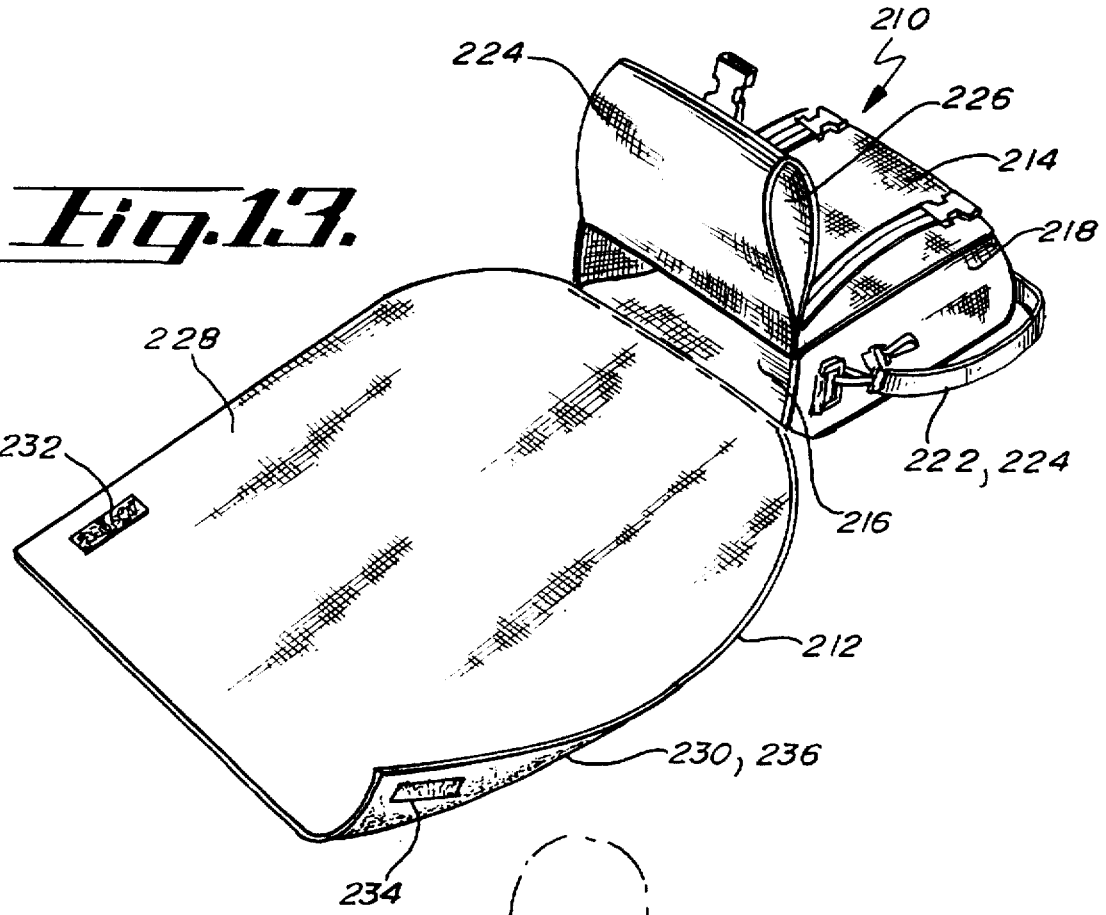
FIG. 13 is a perspective view of an alternate embodiment of the present invention showing a blanket means.

FIG. 13 shows a combination knapsack 210 with a blanket means 212. The combination knapsack 210 has a front wall 214, back wall 216, side walls 218, and base wall 220.

A carrying means 222 is connected to at least one of the front wall 214, back wall 216, side walls 218, and base wall 220 for the user to readily carry the knapsack.

Figure 14:
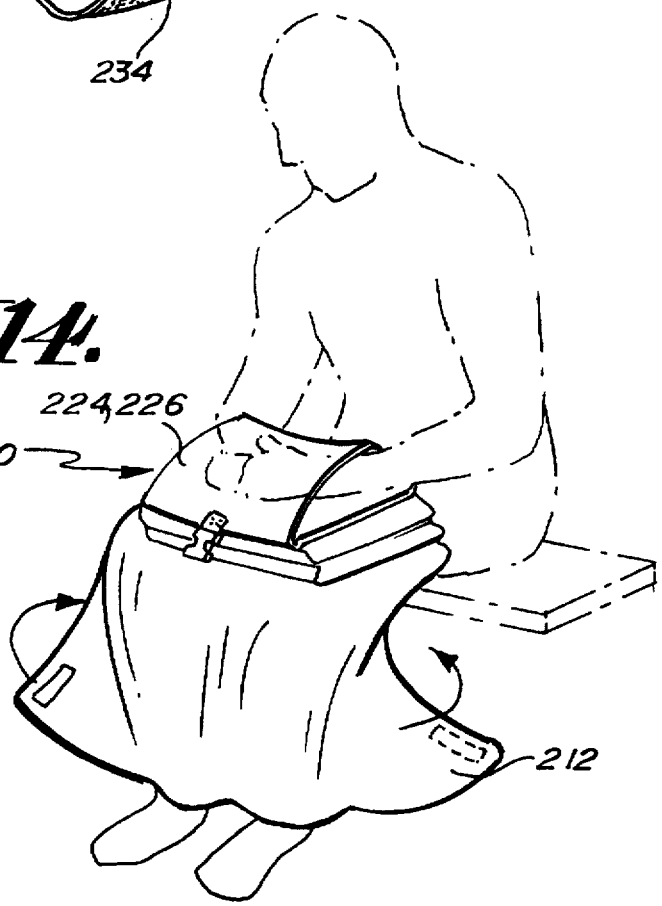
FIG. 14 is a perspective view of the embodiment of FIG. 13 in use on the wearer.

The blanket 212 is permanently attached to one the front wall 214, back wall 216, and base wall 220. The blanket 212 is adapted to cover the wearer's legs in a sitting position as shown in FIG. 14. The blanket 212 is switchable between a storage mode of use in which the blanket 212 is completely retained within the knapsack 210 and an operational mode of use in which the blanket 212 is fully extended outside the knapsack 210, as shown in FIG. 13.

Figure 15:
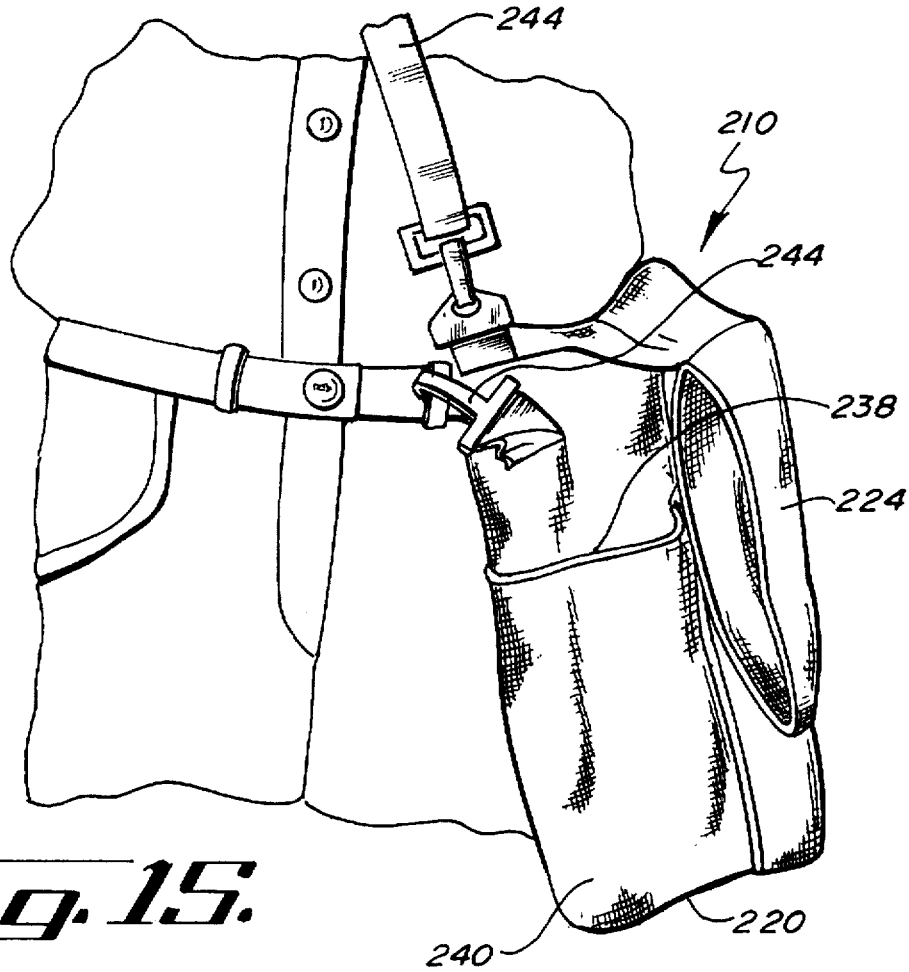
FIG. 15 is a perspective view of the embodiment of FIG. 13 being carried by the user.
Figure 16:
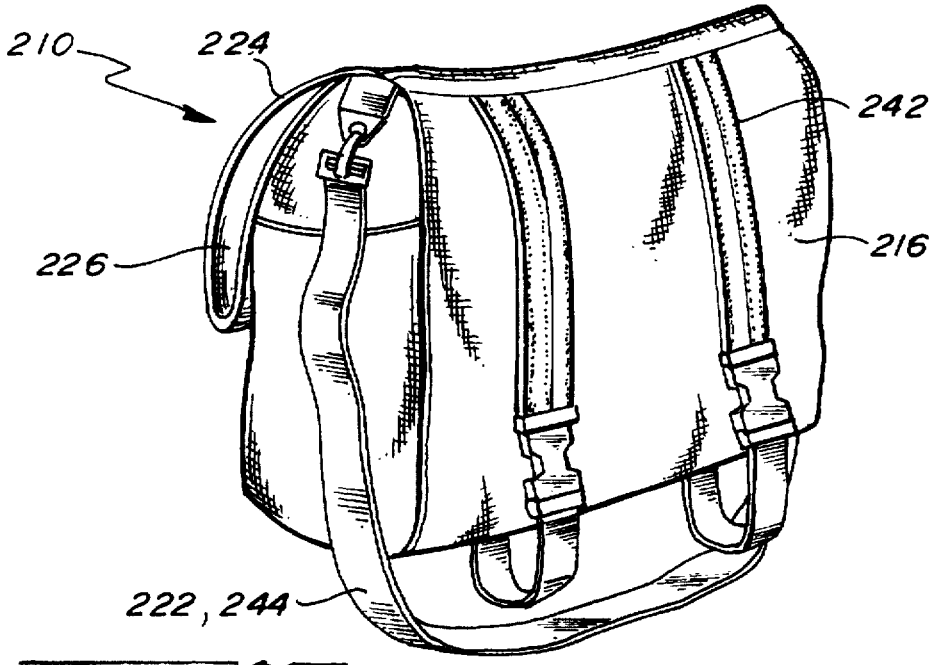
FIG. 16 is a perspective view of the embodiment of FIG. 13 from the rear.

The knapsack 210 also has flap means 224 permanently attached to at least one of the front wall 214, back wall 216, side walls 218, and base wall 220. The flap means 224 is switchable to an open position (FIG. 13) during the operational mode of use and to a closed position (FIG. 15) for use as a protective covering during the storage mode of use.

As can be seen in FIGS. 13 and 14, the flap means 224 preferably further comprises an insulated handwarming muff 226 for the hands of the wearer. Thus, the wearer may be substantially protected from the cold by having both his legs and his hands covered by the knapsack 210 in the operational mode of use.

The blanket 212 preferably comprises an outer layer 228 of strong, washable, pliable yet durable material and an inner insulating layer 230. The inner insulating layer 230 protects the wearer from the cold.

Preferably, fabric hook material 232 and fabric loop material 234 is attached to the blanket 212 such that the blanket 212 can be closed about the wearer's legs by pressing the fabric hook material 232 against the fabric loop material 234. More preferably, the inner insulating layer 230 has a surface 236 comprised of fabric loop material, so that the fabric hook material 232 may be pressed against the surface 236 to close the blanket 212 about the wearer's legs without the necessity to match up the fabric hook material 232 with fabric loop material 234. This is a great advantage in night or low light conditions or windy conditions.

Preferably, the knapsack 210 further comprises one or more secondary compartments 238 defined by one or more of the front wall 214, back wall 216, side walls 218, and base wall 220 and a pocket means 240. The compartments 238 are suitable for storing and retaining items.

The carrying means 222 may preferably comprise straps 242 for carrying the knapsack 210 on the wearer's back. Alternatively, or in addition, the carrying means 222 may comprise a shoulder strap 244. Thus, the knapsack 210 may be carried either on the wearer's back as a traditional knapsack or over the wearer's shoulder as a shoulder bag.

The knapsack 210 may also have connectors 244 for attaching the knapsack 210 to the wearer's waist. In this manner, the knapsack 210 may be prevented from moving around and catching on obstructions as for example when the wearer moves through heavy brush or woods.

The outer layer 228 may comprise camouflage fabric to minimize the chance of the wearer being seen by animals.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A combination knapsack comprising:

a main storage compartment defined by a front wall, a back wall, side walls, and a base wall;

carrying means connected to at least one of said front wall, back wall, side walls, and base wall for a user to readily carry said knapsack;

a blanket permanently attached to one of said front wall, back wall, and base wall, said blanket adapted to cover the wearer's legs in a sitting position and said blanket closable about the wearer's legs, said blanket being switchable between a storage mode of use in which said blanket is completely retained within said knapsack and an operational mode of use in which said blanket is fully extended outside said knapsack; and flap means permanently attached to at least one of said front wall, back wall, and base wall and switchable to an open position during the operational mode of use and to a closed position for use as a protective covering during the storage mode of use, wherein said flap means further comprises an insulated tubular handwarming muff.

2. The combination knapsack of claim 1, wherein said blanket further comprises an outer layer of strong, washable, pliable yet durable material and an inner insulating layer.

3. The combination knapsack of claim 2, wherein fabric hook material and fabric loop material is attached to said blanket, such that said blanket can be closed about the wearer's legs by pressing said fabric hook material against said fabric loop material.

4. The combination knapsack of claim 2, wherein said outer layer comprises camouflage fabric.

5. The combination knapsack of claim 1, further comprising one or more secondary compartments defined by one or more of said front wall, said back wall, said side walls, and said base wall and a pocket means suitable for storing and retaining items.

6. The combination knapsack of claim 1, wherein said carrying means comprises straps for carrying said knapsack on the wearer's back.

7. The combination knapsack of claim 1, wherein said carrying means comprises a shoulder strap.

8. The combination knapsack of claim 1, further comprising connectors for attaching said knapsack to the wearer's waist.

9. A combination knapsack comprising:

a main storage compartment defined by a front wall, a back wall, side walls, and a base wall;

carrying means connected to at least one of said front wall, back wall, side walls, and base wall for a user to readily carry said knapsack;

a blanket permanently attached to one of said front wall, back wall, and base wall, said blanket adapted to cover the wearer's legs in a sitting position and said blanket closable about the wearer's legs, said blanket being switchable between a storage mode of use in which said blanket is completely retained within said knapsack and an operational mode of use in which said blanket is fully extended outside said knapsack; and flap means permanently attached to at least one of said front wall, back wall, and base wall and switchable to an open position during the operational mode of use and to a closed position for use as a protective covering during the storage mode of use, wherein said blanket further comprises an outer layer of strong, washable, pliable yet durable material and an inner insulating layer and wherein fabric hook material is attached to said blanket and said inner insulating layer has a surface substantially entirely comprised of fabric loop material, such that said blanket can be closed about the wearer's legs by pressing said fabric hook material against said fabric loop material and wherein said flap means further comprises an insulated tubular handwarming muff.

10. The combination knapsack of claim 9, further comprising one or more secondary compartments defined by one or more of said front wall, said back wall, said side walls, and said base wall and a pocket means suitable for storing and retaining items.

11. The combination knapsack of claim 9, wherein said carrying means comprises straps for carrying said knapsack on the wearer's back.

12. The combination knapsack of claim 9, wherein said carrying means comprises a shoulder strap.

* * * * *